US009481142B2

(12) United States Patent
Gnan

(10) Patent No.: US 9,481,142 B2
(45) Date of Patent: Nov. 1, 2016

(54) MACHINE FOR PRODUCING CORRUGATED PAPER

(71) Applicant: BHS Corrugated Maschinen— und Anlagenbau GmbH, Weiherhammer (DE)

(72) Inventor: Alfons Gnan, Vilseck (DE)

(73) Assignee: BHS CORRUGATED MASCHINEN— UND ANLAGENBAU GMBH, Weiherhammer (DE)

( * ) Notice: Subject to any disclaimer, the term of this patent is extended or adjusted under 35 U.S.C. 154(b) by 740 days.

(21) Appl. No.: 13/945,625

(22) Filed: Jul. 18, 2013

(65) Prior Publication Data

US 2014/0020840 A1 Jan. 23, 2014

(30) Foreign Application Priority Data

Jul. 19, 2012 (DE) ..... 10 2012 212 699

(51) Int. Cl.
*B31F 1/20* (2006.01)
*B31F 1/28* (2006.01)

(52) U.S. Cl.
CPC ..... *B31F 1/20* (2013.01); *B31F 1/2818* (2013.01); *B31F 1/2831* (2013.01)

(58) Field of Classification Search
None
See application file for complete search history.

(56) References Cited

FOREIGN PATENT DOCUMENTS

| | | | |
|---|---|---|---|
| DE | 3437190 | A1 | 4/1986 |
| DE | 4228074 | A1 | 3/1994 |
| DE | 4241743 | A1 | 6/1994 |
| DE | 19715174 | A1 | 10/1998 |
| DE | 10050348 | C2 | 5/2002 |
| EP | 1086805 | B1 | 3/2001 |

*Primary Examiner* — Barbara J Musser
(74) *Attorney, Agent, or Firm* — Browdy and Neimark, PLLC

(57) ABSTRACT

A machine for producing corrugated paper has a machine frame, a fluted roller and a glue application roller, which can be placed against the fluted roller and between the surface of which and the fluting the paper web to be provided with a corrugation and to be partially glued can be guided through. Provided between the fluted roller and the glue application roller and to the side of the fluting is at least one spacer, which maintains a safety gap with a gap width d between the surface of the glue application roller and the fluting, the gap width d being smaller than the smallest thickness of the paper web.

7 Claims, 3 Drawing Sheets

MACHINE FOR PRODUCING CORRUGATED PAPER

CROSS-REFERENCES TO RELATED APPLICATIONS

This application claims the priority of German Patent Application, Serial No. 10 2012 212 699.6, filed Jul. 19, 2012, pursuant to 35 U.S.C. 119(a)-(d), the content of which is incorporated herein by reference in its entirety as if fully set forth herein.

FIELD OF THE INVENTION

The invention relates to a machine for producing corrugated cardboard from at least one corrugated paper web having a smallest thickness d and at least one liner web, with a machine frame, with a fluted roller, which is mounted in the machine frame, with a fluting and with a glue application roller, which is placeable against the fluted roller and between the surface of which glue application roller and the fluting the paper web to be provided with a corrugation and to be partially glued is guidable through.

BACKGROUND OF THE INVENTION

Machines of this type are known, for example, from EP 1 086 805 B1, it being possible to load a glue application roller by means of pressure devices in the direction of the fluted roller, by means of which the glue application roller is pressed using a predetermined contact pressure against the paper web located on the fluted roller in order to allow a uniform gluing of the tips of the corrugations of the paper web. Stop rings, which only project slightly over the surface of the glue application roller, are attached to the glue application roller. To calibrate the gluing gap to be formed between the fluted roller and glue application roller, the glue application roller is pressed against the fluted roller by means of the pressure devices, the stop rings resting against the fluting. The glue application roller is then moved away from the fluted roller again by a predetermined amount. Alternatively, the stop rings can also be omitted. The glue application roller is, in this case, placed directly against the fluted roller for calibration.

It has been shown in practice that in the event of a tear of a paper web, the glue application roller can impact on the fluted roller, whereby the surface of the fluting can be damaged.

It is known from DE 100 50 348 C2, to provide discs rolling on one another on the axles of pairs of corrugated rollers in order to ensure a predetermined gap between the flutings of the two intermeshing fluted rollers.

SUMMARY OF THE INVENTION

The invention is based on an object of configuring a machine of the generic type in such a way that damage to the fluting of the fluted roller due to impingement of the glue application roller when there is a paper tear or the like is prevented.

This object is achieved according to the invention by a machine, in which provided between the fluted roller and the glue application roller and to the side of the fluting is at least one spacer, which maintains a safety gap with a gap width d between the surface of the glue application roller and the fluting, the gap width d being smaller than the smallest thickness of the paper web, in which the at least one spacer has a stop ring arranged on one of the glue application roller and the fluted roller and a support face arranged on one of the fluted roller and the glue application roller, wherein on touch of the stop ring and the support face, the safety gap is limited and in which a cleaning scraper rests on the support face. The essential of the invention is that when no paper web is located between the glue application roller and fluted roller, an impact of the glue application roller on the fluting of the fluted roller is avoided without the spacers in any form being able to come into contact with the fluting of the fluted roller or the surface of the glue application roller. During normal operation, when a paper web is, in other words, located between the glue application roller and fluted roller, the spacer(s) do not function, in other words they are not engaged with one another. The operating unit of the spacers is ensured by the cleaning scrapers.

The safety gap is smaller than the thinnest paper web occurring in practice. According to an advantageous embodiment, there applies to the gap width d of the safety gap (40): 0.06 mm≤d≤0.12 mm.

According to an advantageous embodiment, the stop ring is formed on the glue application roller and the cylindrical support face is formed on the fluted roller. According to a further advantageous embodiment, the support face is formed on a support ring. According to a further advantageous embodiment, the support face is formed on the fluted roller.

A machine, in which a spacer is in each case provided on both sides of the fluting, ensures that a uniformly symmetrical guidance is always ensured.

A machine, in which the glue application roller is loadable with at least one pressure device in the direction of the fluted roller, describes a known pressure device, which may be the cause of an impact of the gluing roller on the fluting of the fluted roller in the event of tear of the paper web.

Further features, advantages and details of the invention emerge from the following description of two embodiments with the aid of the drawings.

DESCRIPTION OF THE PREFERRED EMBODIMENTS

Figure 1:
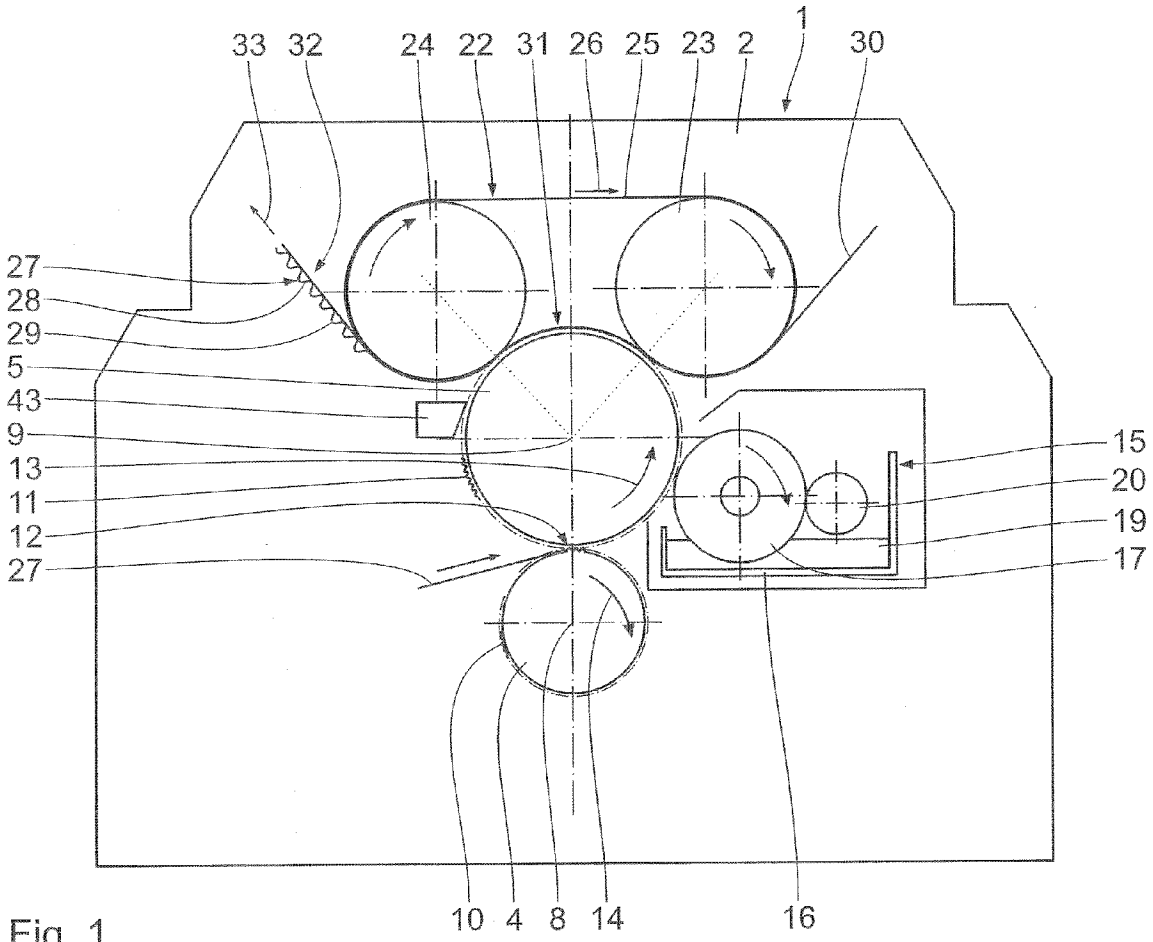
FIG. 1 shows a machine for producing a corrugated cardboard web lined on one side in a side view.

A machine frame 1 of a machine for producing a corrugated cardboard web lined on one side has two mutually parallel side walls 2, 3, in which a lower fluted roller 4 and an upper fluted roller 5 are mounted. As emerges from FIG. 2 only for the upper fluted roller 5, these are mounted by means of shaft journals 6 in bearings 7, which are supported in the side walls 2 or 3. The fluted rollers 4, 5 have mutually parallel axes 8, 9. On their cylinder surfaces, the fluted rollers 4, 5 are provided with flutings 10, 11, which extend parallel to the axes 8, 9 and mesh with one another in the contact region 12 of the two fluted rollers 4, 5. One of the fluted rollers 4, 5, generally the upper fluted roller 5, can be driven in the rotational direction 13, while the other fluted roller, in other words generally the lower fluted roller 4, is entrained by the other fluted roller 5 in the rotational direction 14.

Arranged downstream of the contact region 12 in the rotational direction 13 or 14 in the machine frame 1 is a glue application device 15, which has a glue container 16 held in the machine frame 1. A glue application roller 17, which can be driven to rotate by a drive motor 18, is mounted in said glue container. The glue application roller 17 dips into a glue bath 19, above which a squeezing roller 20 is arranged, which is also mounted in the glue container 16 and, with the glue application roller 17, limits a glue gap. The glue application roller 17 becomes loadable by means of pressure devices 21 with a predetermined force in the direction of the upper fluted roller 5. These pressure devices 21 are configured as hydraulically loadable piston cylinder drives, as indicated in the drawing. These pressure devices 21 and their activation are known from EP 1 086 805 B1 (corresponding to U.S. Pat. No. 6,692,602 B1), to which reference may be made.

A pressure device 22, which has a cylindrical deflection roller 23, a tensioning roller 24 and a pressure band 25, is provided above the upper fluted roller 5. The pressure band 25 rests against the fluting 11 of the upper fluted roller 5 and revolves therewith in the same rotational direction in accordance with the arrow 26. The configuration of pressure devices 22 of this type is generally known.

As can be inferred, in particular from FIG. 1, a paper web 27, which is provided with a corrugation 28 by means of the flutings 10, 11, is introduced in the contact region 12 between the lower fluted roller 4 and upper fluted roller 5. The tips 29 of the respective corrugation 28 are provided with glue by the glue application roller 17 in the glue application device 15. The remaining regions of the corrugated paper web 27 are not provided with glue. A liner web 30, which also consists of paper and has the same width as the paper web 27, is fed by means of the deflection roller 23. This liner web 30 is entrained by the pressure band 25 and pressed in the pressure region 31 formed between the pressure band 25 and upper fluted roller 5 onto the tips 29 of the corrugated paper web 27 located in the fluting 11 of the upper fluted roller 5 and connected thereto. The upper fluted roller 5 is heated in the conventional manner. The completely glued corrugated paper web 32 lined on one side with a liner web 30 runs off together with the pressure band 25 from the upper fluted roller 5. From there, it is fed to a winding device in the draw-off direction 33.

A stop ring 36 or 37 projecting radially over the cylindrical surface 35 of the glue application roller 17 is in each case arranged on the end faces 34 of the glue application roller 17. The spacing a of the two stop rings 36, 37 from one another parallel to the axis 8 is greater than the axially parallel extent b of the fluting 11. The arrangement of the stop rings 36, 37 is thus such that they are unable to come into contact with the fluting 11 of the upper fluted roller 5. On both sides of the fluting 11 of the upper fluted roller 5, support rings 38, 39 are attached to the upper fluted roller 5, the average spacing c of which from one another corresponds approximately to the spacing a, so that upon a movement of the glue application roller 17 against the upper fluted roller 5, the stop rings 36, 37 come to rest against the support rings 38 or 39, a gap 40 shown significantly enlarged, with a gap width d remaining between the cylindrical surface 35 of the glue application roller 17 and the fluting 11 of the upper fluted roller 5, said gap width d being smaller than the smallest thickness of 0.08 mm of the paper that can be used on the machine for the paper web 27. To the gap width d there applies 0.06 mm≤d≤0.12 mm. The pairs of stop ring 36 or 37 and support rings 38, 39 thus form spacers 41, 42.

A scraper 43 fixed in the machine frame 1 rests in each case against the support rings 38, 39, the scraper cleaning the cylindrical surface, in other words the support face 44, against which the stop rings 36 or 37 can run, of soiling by glue, paper fibres and the like.

Figure 2:
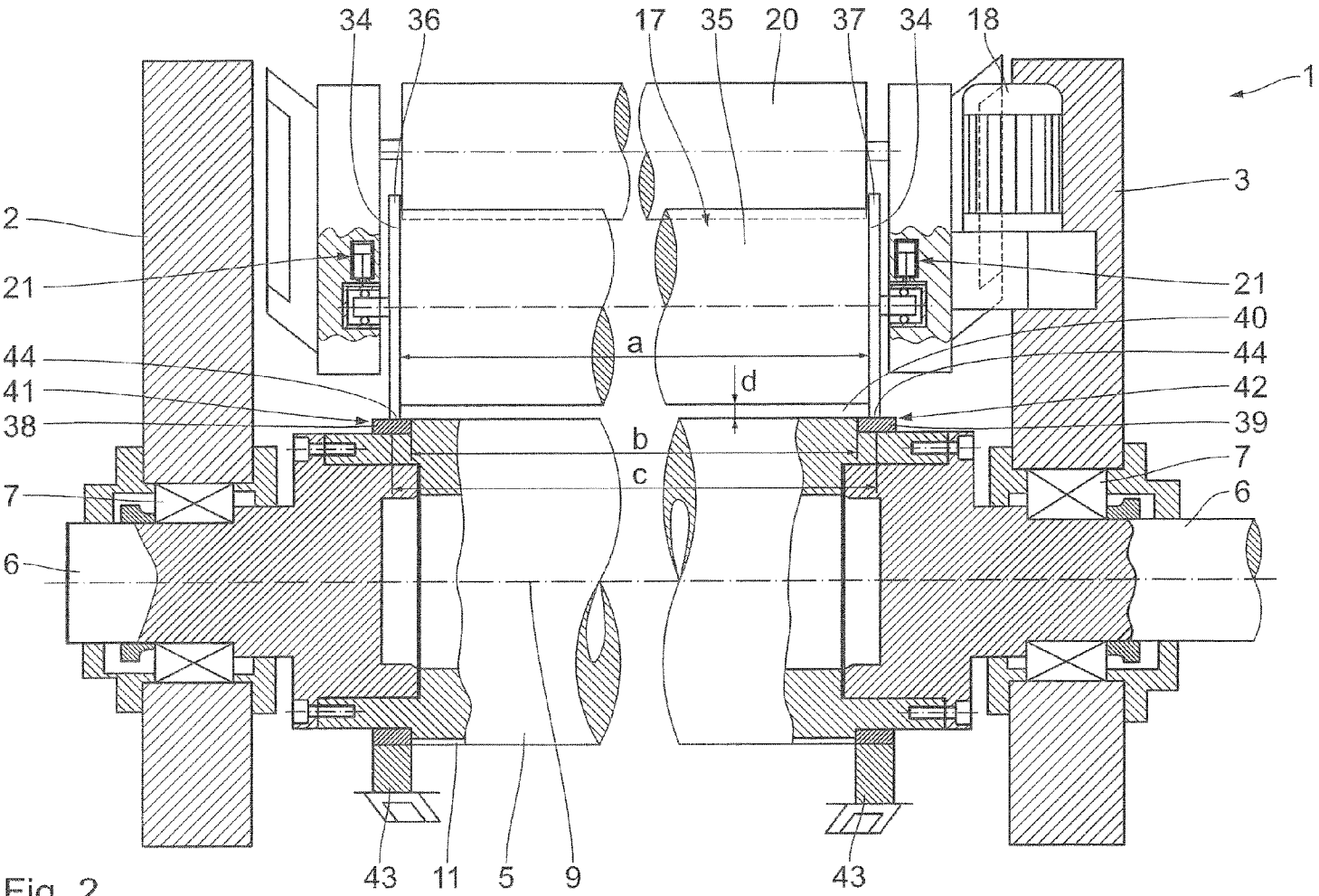
FIG. 2 shows a horizontal longitudinal section through the machine according to FIG. 1.

The support rings 38, 39 consisting of particularly wear-resistant material—as FIG. 2 shows—are exchangeably arranged on the fluted roller 5.

Figure 3:
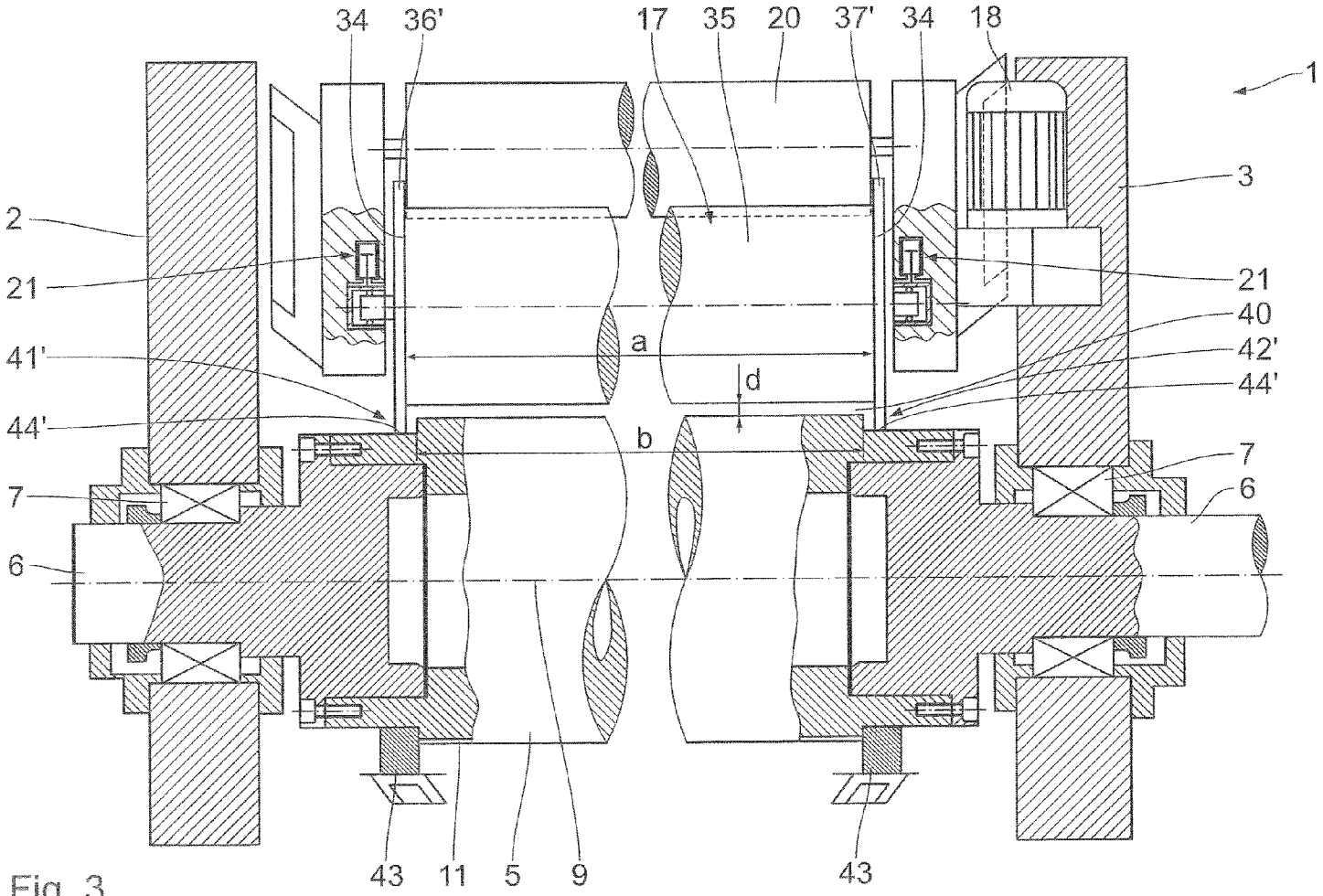
FIG. 3 shows a horizontal longitudinal section through a slightly modified embodiment of the machine for producing a corrugated cardboard web lined on one side in a view corresponding to FIG. 2.

The embodiment according to FIGS. 1 and 3 differs from that according to FIGS. 1 and 2 substantially only in that the stop rings 36', 37' project radially further over the cylindrical surface 35 of the glue application roller 17. They cooperate directly with support faces 44' formed on the upper fluted roller 5 to the side of its fluting 11 and form spacers 41', 42' therewith. Scrapers 43 also rest against the support faces 44'. A safety gap 40 is also ensured in this configuration if the glue application roller 17 could impinge against the fluting 11, for example in the event of a tear of the paper web 27, which could happen because of the action of the pressure device 21.

What is claimed is:

1. A machine for producing corrugated cardboard from at least one corrugated paper web having a smallest thickness and at least one liner web, comprising:

a machine frame, a fluted roller, which is mounted in the machine frame, with a fluting and a glue application roller, which is placeable against the fluted roller and between the surface of which glue application roller and the fluting the paper web to be provided with a corrugation and to be partially glued is guidable through, wherein provided between the fluted roller and the glue application roller and to the side of the fluting is at least one spacer, which maintains a safety gap with a gap width d between the surface of the glue application roller and the fluting, the gap width d being smaller than the smallest thickness of the paper web, wherein the at least one spacer has a stop ring arranged on one of the glue application roller and the fluted roller and a support face arranged on one of the fluted roller and the glue application roller, wherein on touch of the stop ring and the support face, the safety gap is limited and wherein a cleaning scraper rests on the support face.

2. A machine according to claim 1, wherein there applies to the gap width d of the safety gap: 0.06 mm≤d≤0.12 mm.

3. A machine according to claim 1, wherein the stop ring is formed on the glue application roller and the cylindrical support face is formed on the fluted roller.

4. A machine according to claim 1, wherein the support face is formed on a support ring.

5. A machine according to claim 1, wherein the support face is formed on the fluted roller.

6. A machine according to claim 1, further comprising two spacers, each spacer being disposed on one side of the fluting.

7. A machine according to claim 1, wherein the glue application roller is loadable with at least one pressure device in the direction of the fluted roller.

* * * * *